US008426094B2

(12) United States Patent
Magome et al.

(10) Patent No.: US 8,426,094 B2
(45) Date of Patent: Apr. 23, 2013

(54) MAGNETIC TONER

(75) Inventors: Michihisa Magome, Mishima (JP); Takashi Matsui, Suntou-gun (JP); Tomohisa Sano, Mishima (JP); Shuichi Hiroko, Susono (JP); Yoshitaka Suzumura, Mishima (JP); Shotaro Nomura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 175 days.

(21) Appl. No.: 13/115,576

(22) Filed: May 25, 2011

(65) Prior Publication Data

US 2011/0294056 A1 Dec. 1, 2011

(30) Foreign Application Priority Data

May 31, 2010 (JP) ..... 2010-123674

(51) Int. Cl.
*G03G 9/00* (2006.01)

(52) U.S. Cl.
USPC ..... 430/106.2

(58) Field of Classification Search ..... 430/106.2
See application file for complete search history.

(56) References Cited

U.S. PATENT DOCUMENTS

| | | | |
|---|---|---|---|
| 5,424,810 | A | 6/1995 | Tomiyama et al. |
| 5,948,582 | A | 9/1999 | Nakamura et al. |
| 6,007,957 | A | 12/1999 | Kobori et al. |
| 6,051,350 | A | 4/2000 | Inaba et al. |
| 6,077,635 | A | 6/2000 | Okado et al. |
| 6,077,636 | A | 6/2000 | Moriki et al. |
| 6,183,927 | B1 | 2/2001 | Magome et al. |
| 6,287,739 | B1 | 9/2001 | Kawakami et al. |
| 6,447,968 | B1 | 9/2002 | Ohno |
| 6,447,969 | B1 | 9/2002 | Ito et al. |
| 6,465,144 | B1 | 10/2002 | Hashimoto et al. |
| 6,544,708 | B2 | 4/2003 | Komoto et al. |
| 6,596,452 | B2 | 7/2003 | Magome et al. |
| 6,638,674 | B2 | 10/2003 | Komoto et al. |
| 6,653,035 | B2 | 11/2003 | Komoto et al. |
| 7,043,175 | B2 | 5/2006 | Komoto et al. |
| 7,123,862 | B2 | 10/2006 | Hasegawa et al. |
| 7,361,442 | B2 | 4/2008 | Otake et al. |

(Continued)

FOREIGN PATENT DOCUMENTS

| | | | |
|---|---|---|---|
| JP | 5-72801 | A | 3/1993 |
| JP | 10-239897 | A | 9/1998 |
| JP | 11-316474 | A | 11/1999 |

OTHER PUBLICATIONS

Hiroko, et al., U.S. Appl. No. 13/205,599, filed Aug. 8, 2011.
Matsui, et al., U.S. Appl. No. 13/159,172, filed Jun. 13, 2011.

*Primary Examiner* — Mark A Chapman
(74) *Attorney, Agent, or Firm* — Fitzpatrick, Cella, Harper & Scinto

(57) ABSTRACT

A magnetic toner has magnetic toner particles, each of the magnetic toner particles containing a binder resin and a magnetic material, and an inorganic fine powder. The magnetic material is prepared by treating the surface of magnetic iron oxide with a silane compound. When the magnetic iron oxide is dispersed in an aqueous solution of hydrochloric acid and dissolved until the dissolution proportion of the iron element reaches 5% by mass based on the total amount of the iron element contained in the magnetic iron oxide, the amount of silicon eluted by that point of time is 0.05% by mass or more and 0.50% by mass or less based on the magnetic iron oxide. The magnetic material has a moisture adsorption amount per unit area of 0.30 mg/m$^2$ or less.

4 Claims, 2 Drawing Sheets

U.S. PATENT DOCUMENTS

| | | | |
|---|---|---|---|
| 7,371,494 | B2 | 5/2008 | Chiba et al. |
| 7,452,649 | B2 | 11/2008 | Magome et al. |
| 7,560,212 | B2 | 7/2009 | Chiba et al. |
| 7,582,401 | B2 | 9/2009 | Ogawa et al. |
| 7,678,523 | B2 | 3/2010 | Hiroko et al. |
| 7,678,524 | B2 | 3/2010 | Hasegawa et al. |
| 7,811,734 | B2 | 10/2010 | Ogawa et al. |
| 7,842,446 | B2 | 11/2010 | Yanase et al. |
| 7,906,266 | B2 | 3/2011 | Magome et al. |
| 7,923,190 | B2 | 4/2011 | Magome et al. |
| 7,935,467 | B2 | 5/2011 | Dojo et al. |
| 2007/0072102 | A1 | 3/2007 | Dojo et al. |
| 2009/0047043 | A1 | 2/2009 | Dojo et al. |
| 2009/0117477 | A1 | 5/2009 | Magome et al. |
| 2009/0197192 | A1 | 8/2009 | Hiroko et al. |
| 2010/0266943 | A1 | 10/2010 | Sano et al. |

MAGNETIC TONER

BACKGROUND OF THE INVENTION

1. Field of the Invention

The present invention relates to a magnetic toner used for recording methods utilizing electrophotographic methods and the like.

2. Description of the Related Art

A large number of methods are known as the electrophotographic method. Generally speaking, in the method, an electrostatic latent image is formed on an electrostatic latent image bearing member (hereinafter, also referred to as a "photosensitive member") utilizing photoconductive materials with the aid of various techniques. Successively, the latent image is rendered visible by developing it with a toner. The thus formed toner image is transferred to a recording medium such as paper where necessary and is then fixed on the recording medium by the application of heat or pressure to produce a duplicate. Examples of such an image forming apparatus include a copying machine and a printer.

Such printers and copying machines recently undergo the progress of the transition from analog to digital apparatuses, and are intensely required to be excellent in the reproducibility of the latent image and high in resolution, and at the same time to always offer an image of high image quality in a stable manner even under various use circumstances. The various use circumstances as referred to herein mean the use conditions as well as the installation environment and the operation environment of printers and the like.

From the viewpoint of the ways of use of the printers, medium- or high-speed printers operated in offices or the like are large in print volume and high in operation rate, and on the contrary, compact, low-speed printers are small in print volume and sometimes are left unused for printing over a long period of time.

It has been realized that as a result of the printers being left unused for a long period of time, specific problems ascribable thereto occur. Specifically, there occurs a problem of image density degradation after a long-term retention of printers in an environment of high temperature and high humidity. Such a problem tends to conspicuously occur particularly in a case where printers have been left unused for a long period of time after attainment of the conditions that the amount of the remaining toner becomes small due to printing of a large number of sheets with a low coverage rate and a small number of printed sheets per one job. This is ascribable to the reason that the low coverage rate of each printed sheet enables printing of a large number of sheets to thereby accelerate the degradation of the toner, or alternatively, the low coverage rate results in exclusively selective consumption (what is called "selective development") of the toner particles retaining an appropriate amount of charges and hence the fraction of the toner particles retaining an appropriate amount of charges is gradually decreased to cause difficulty in performing a desired development.

After printing of a large number of sheets, the chargeability of the toner is degraded, and consequently, the shading unevenness called "ghost" tends to occur on the image.

When printers are left unused in an environment of high temperature and high humidity, the toner eventually absorbs water to disturb the charging, and hence the developability may be degraded. The water absorbability of the toner mainly depends on the raw materials constituting the toner and the state of being of the toner. In general, the magnetic material used in a magnetic toner is more hydrophilic and more easily absorbs moisture as compared with the binder resin. On the other hand, toners obtained by pulverization (hereinafter, referred to as pulverized toners) tends to undergo the exposure of the magnetic material on the toner surface and tends to absorb moisture.

In this connection, there have been proposed toners improved in the environmental stability by making a magnetic material contain silicon and by controlling the state of being of the magnetic material (see Japanese Patent Application Laid-Open Nos. H05-72801 and H11-316474). However, even the use of such toners has left room for improvement of the density stability and ghost when allowed to stand after continuous running in an environment of high temperature and high humidity.

Further, there has been offered a proposal that the environmental stability is improved by specifying the content of silicon in the magnetic material, and, at the same time, by using a magnetic material having been treated with a surface modifying agent to modify the surface (see Japanese Patent Application Laid-Open No. H10-239897). This toner is improved in the environmental stability by enclosing the magnetic material inside the toner particles through performing suspension polymerization with the aid of the thus treated magnetic material and to thereby prevent the exposure of the magnetic material to the surface of the toner particles. However, even the use of such a treated magnetic material has left room for improvement of the density stability when allowed to stand after continuous running in an environment of high temperature and high humidity. This is ascribable to the fact that the magnetic material present in the vicinity of the surface of the toner particles is made to adsorb moisture by being allowed to stand over a long period of time.

As described above, there has been left room for further improvement with respect to the running stability in an environment of high temperature and high humidity and the density stability and ghost when allowed to stand after continuous running.

SUMMARY OF THE INVENTION

In view of the above-described prior art problems, an object of the present invention is to provide a magnetic toner having an excellent running stability in an environment of high temperature and high humidity, and, at the same time, being capable of obtaining an image high in image density and free from ghost even when allowed to stand after continuous running.

The present invention relates to a magnetic toner comprising magnetic toner particles, each of the magnetic toner particles containing a binder resin and a magnetic material; and an inorganic fine powder, wherein: (1) the magnetic material is prepared by treating magnetic iron oxide on the surface with a silane compound; (2) when the magnetic iron oxide is dispersed in an aqueous solution of hydrochloric acid and dissolved until the dissolution proportion of the iron element reaches 5% by mass based on the total amount of the iron element contained in the magnetic iron oxide, the amount of silicon eluted by that point of time is 0.05% by mass or more and 0.50% by mass or less based on the magnetic iron oxide; and (3) the magnetic material has a moisture adsorption amount per unit area of 0.30 $mg/m^2$ or less.

The magnetic toner of the present invention has an excellent running stability in an environment of high temperature and high humidity, and, at the same time, is capable of obtaining an image high in image density and free from ghost even when allowed to stand after continuous running.

Further features of the present invention will become apparent from the following description of exemplary embodiments with reference to the attached drawings.

DESCRIPTION OF THE EMBODIMENTS

Figure 1:
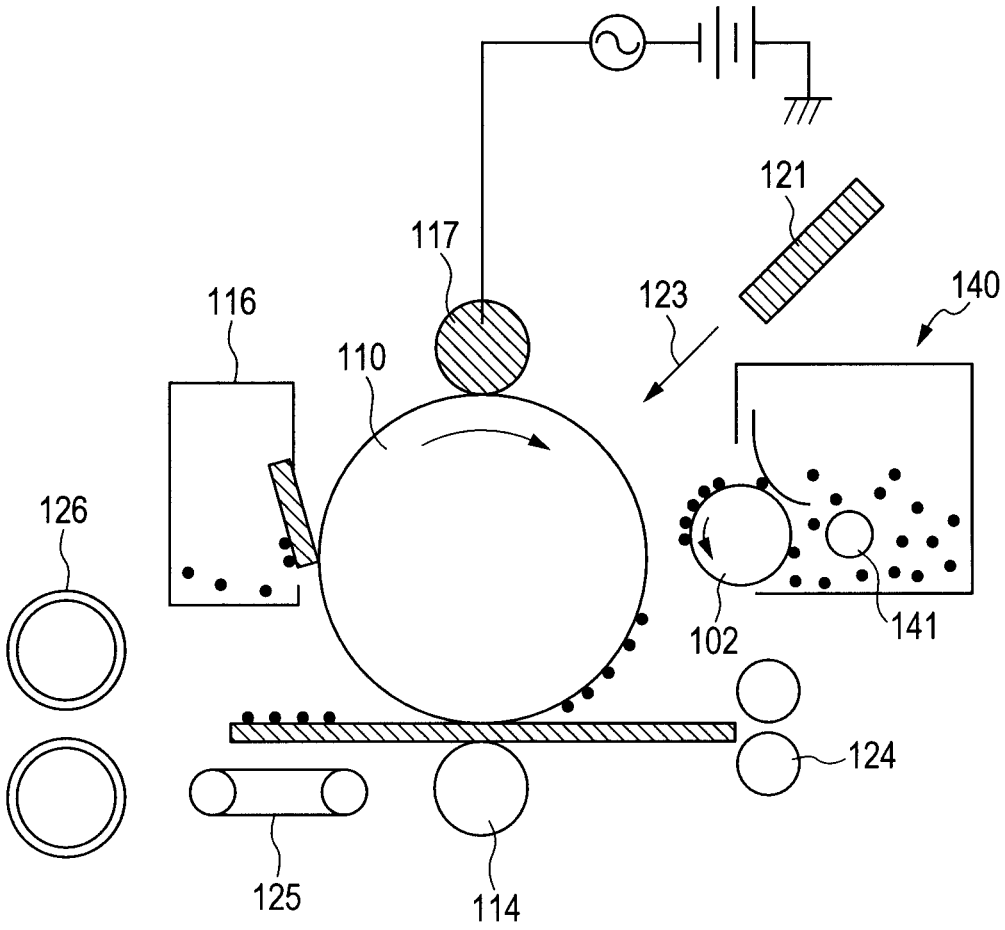
FIG. 1 is a schematic view of an image forming apparatus capable of preferably using the toner of the present invention.

Preferred embodiments of the present invention will now be described in detail in accordance with the accompanying drawings.

The present inventors made a diligent study and consequently have found that it is essential to use a magnetic material which is prepared by making the silicon element be present in a specific amount on the surface of magnetic iron oxide and by surface-treating the surface of the magnetic iron oxide with a silane compound. The present inventors reached the present invention by further discovering that the moisture adsorption amount per unit area of the magnetic material controlled to 0.30 $mg/m^2$ or less enables to suppress the degradation of the image density and the occurrence of ghost due to being allowed to stand in an environment of high temperature and high humidity. To begin with magnetic iron oxide, functional groups, such as hydroxyl groups, are present on the surface of magnetic iron oxide. Such functional groups adsorb moisture, and hence the environmental stability of the toner is degraded. Accordingly, it is very important to enhance the environmental stability by performing chemical modification (surface treatment) of such functional groups. Here, in general, compounds such as silane compounds, titanate compounds and aluminate compounds are known as the surface-treating agent; these surface-treating agents all undergo hydrolysis and perform condensation reaction with the hydroxyl groups on the surface of magnetic iron oxide, and thus acquire strong chemical bonds to display hydrophobicity. However, it is known that these compounds having undergone hydrolysis are allowed to be self-condensed and tend to produce polymers and oligomers. According to a diligent study made by the present inventors, the titanate compounds and the aluminate compounds tend to undergo self-condensation subsequent to the hydrolysis and hence impede uniform treatment on the surface of magnetic iron oxide. This fact may be because the activities of titanium and aluminum contained in the titanate compounds and the aluminate compounds are high.

In contrast to this, the control of the hydrolysis conditions allows the silane compounds to suppress the self-condensation while the hydrolysis rate is increased, and thus allows the surface of magnetic iron oxide to be uniformly treated. According to the present inventors, this is because the activity of silicon contained in the silane compounds is not so high as compared with the activities of titanium and aluminum. Accordingly, it is important to use the silane compounds.

Moreover, as described below, the magnetic iron oxide of the present invention has the silicon element present on the surface thereof. Therefore, the affinity between the surface of the magnetic iron oxide and the silane compound is improved, and thus the uniformity of the treatment with the silane compound is more improved. The improvement of the affinity between the surface of the magnetic iron oxide and the silane compound also leads to the increase in the amount of the silane compound bonded to the surface of the magnetic iron oxide. Consequently, the environmental stability of the toner is made better, and, at the same time, the dispersibility of the magnetic material among the toner particles is made very satisfactory, and the occurrence of the selective development can be suppressed and a satisfactory developability can be maintained even after a large number of sheets have been printed with a low coverage rate.

In the present invention, from the above-described reasons, it is important to make the silicon element be present in a specific amount on and in the vicinity of the surface of the magnetic iron oxide. Specifically, when the magnetic iron oxide is dispersed in an aqueous solution of hydrochloric acid and dissolved until the dissolution proportion of the iron element reaches 5% by mass based on the total amount of the iron element contained in the magnetic iron oxide, the amount of silicon eluted by that point of time is 0.05% by mass or more and 0.50% by mass or less based on the magnetic iron oxide.

Here, the dissolution proportion of the iron element of the magnetic iron oxide, as referred to herein, is such that the dissolution proportion of the iron element of 100% by mass means the condition that the magnetic iron oxide is completely dissolved, and the closer to 100% by mass is the numerical value of the dissolution proportion, the closer is the dissolution to the condition that the whole magnetic iron oxide is dissolved. According to a diligent study made by the present inventors, the magnetic iron oxide is dissolved uniformly from the surface thereof under an acidic condition. Therefore, the amounts of the elements, eluted until the time point where the dissolution proportion of the iron element reaches 5% by mass, can be taken to indicate the amounts of the elements present on and in the vicinity of the surface of the magnetic iron oxide.

When the amount of the silicon present on and in the vicinity of the surface of the magnetic iron oxide is 0.05% by mass or more, the affinity between the silane compound and the magnetic iron oxide is improved as described above, and the uniformity and the like of the treatment are improved. Consequently, the amount of moisture adsorbed in the magnetic material can be suppressed to a low level.

On the other hand, if the amount of the silicon present on and in the vicinity of the surface of the magnetic iron oxide is larger than 0.50% by mass, disadvantageously the environmental stability of the toner tends to be degraded. The reasons for this may be assumed as follows. The silane compound used for the surface treatment of the surface of the magnetic iron oxide is confined to a certain level of area (coverage area) which one molecule can cover. Accordingly, for the maximum amount of the silane compound capable of being condensed per unit area, the upper limit of this maximum amount is determined according to the coverage area. From such a reason, if the silicon content is larger than 0.50% by mass, the silicon and the silanol group derived from the silicon excessively remain on the surface of the magnetic iron oxide, and consequently the surface turns into a surface tending to adsorb moisture and the environmental stability of the toner is made poor.

Next, in the present invention, it is important that the magnetic material (magnetic iron oxide treated with a silane compound) has a moisture adsorption amount per unit area of 0.30 $mg/m^2$ or less, and more preferably 0.25 $mg/m^2$ or less. The moisture adsorption amount of the treated magnetic material of 0.30 $mg/m^2$ or less means that the treatment of the surface of the magnetic iron oxide is uniform and the surface of the magnetic iron oxide has been treated with a sufficient amount of the treating agent. By using such a treated magnetic material in a toner, the adsorption of moisture by the toner is made to hardly occur and the environmental stability of the toner is improved, and the chargeability of the toner can also be maintained satisfactorily even when the toner is allowed to stand in an environment of high temperature and high humidity.

On the other hand, if the treated magnetic material has a moisture adsorption amount per unit area larger than 0.30 $mg/m^2$, in particular, in the case where the toner is allowed to stand in an environment of high temperature and high humidity after a large number of sheets have been printed, disadvantageously the chargeability of the toner comes to be poor and the density degradation and the occurrence of ghost tend to be caused.

As has been described above, by making the silicon element be present in a specific amount on the surface of the magnetic iron oxide and by surface-treating the surface of the magnetic iron oxide with a silane compound, the dispersibility of the magnetic material is made very satisfactory and the selective development is made to hardly occur. Further, by making the magnetic material have a moisture adsorption amount per unit area of 0.30 $mg/m^2$ or less, the amount of moisture adsorbed by the toner is decreased and the chargeability of the toner is made better. As a result of the synergetic effect of these two effects, even when the toner is allowed to stand in an environment of high temperature and high humidity after a large number of sheets have been printed with a low coverage rate, no degradation of the image density occurs. In addition to the fact that the toner of the present invention has a small amount of moisture adsorption, the toner hardly undergoes the selective development, and hence the rise of the charging of the toner is fast even after the toner has been allowed to stand and the ghost phenomenon can be improved.

The moisture adsorption amount per unit area of the magnetic material can be controlled through the amount of the silane compound used for the surface treatment, the state of the silane compound, the conditions of the drying after the treatment with the silane compound, the amount of silicon present on the surface of the magnetic iron oxide and others. Specifically, it is preferable to use a silane compound whose hydrolysis rate (described below) is 50% or more and self-condensation rate (described below) is 30% or less. Very preferably, the using of such a silane compound enables the surface of the magnetic iron oxide to be uniformly treated.

The amount of the silane compound used for the treatment depends on the specific surface area of the magnetic iron oxide, and is preferably 0.5 part by mass or more and 5.0 parts by mass or less based on 100 parts by mass of the magnetic iron oxide. If the amount of the silane compound used for the treatment is too small, the amount of moisture adsorbed by the treated magnetic material is increased, and if the amount of the silane compound used for the treatment is too large, the aggregation of the treated magnetic material occurs undesirably.

In the present invention, the silane compound used for uniformly treating the surface of the magnetic iron oxide is preferably a silane compound having been subjected to hydrolysis. In general, in many cases, silane compounds are used without being subjected to hydrolysis and the surface treatment is performed with such silane compounds as they are; however, in this way, the silane compounds cannot have any chemical bonds with the hydroxyl groups and others on the surface of the magnetic iron oxide, and are only caused to be present on the surface of the magnetic iron oxide with strengths of the order of physical attachment. Under such a condition, the silane compound tends to be eliminated from the surface by the shear exerted to the magnetic iron oxide when the toner is formed. In general, when the surface treatment is performed, heat is applied after the silane compound has been added and mixed. However, according to a detailed investigation performed by the present inventors, upon the application of heat at approximately 100° C. to 120° C., a silane compound having never been hydrolyzed volatilizes from the surface of the magnetic iron oxide. Consequently, after the volatilization of the silane compound, hydroxyl groups and silanol groups remain on the surface of the magnetic iron oxide and it is difficult to meet the moisture adsorption amount specified in regard to the present invention. From these reasons, in the present invention, the silane compound is preferably a product prepared by hydrolyzing an alkoxysilane. As a result of hydrolysis, the silane compound adsorbs on the surface of the magnetic iron oxide through the hydrogen bonding with the hydroxyl groups and others on the surface of the magnetic iron oxide, and heating and dehydration of such adsorption form strong chemical bonds. The formation of the hydrogen bonds also enables to suppress the volatilization of the silane compound at the time of heating, and facilitates the preparation of a product meeting the specification related to the moisture adsorption amount.

In the present invention, from such reasons, the hydrolysis rate of the silane compound is preferably 50% or more and more preferably 70% or more. When the hydrolysis rate of the silane compound is 50% or more, the surface of the magnetic iron oxide can be treated with a larger amount of the treating agent owing to the above-described reasons. Moreover, the uniformity of the surface treatment is enhanced and the dispersibility of the magnetic material is made further better. Consequently, very preferably, the selective development is made to hardly occur to a more enhanced extent, and, at the same time, the degradation of the density after the toner having been allowed to stand is made to hardly occur. The hydrolysis rate of the silane compound is such that the hydrolysis rate is 100% in the case where the alkoxysilane is completely hydrolyzed and the value of the hydrolysis rate is obtained by subtracting the proportion of the remaining alkoxy group therefrom.

The self-condensation rate of the silane compound is preferably 30% or less and more preferably 20% or less. If the self-condensation rate of the silane compound is 30% or less, it is easy to uniformly treat the surface of the magnetic iron oxide. Thus, the moisture adsorption amount of the magnetic material is preferably reduced.

The reason for this is assumed as follows. The functional groups such as hydroxyl groups present on the surface of the magnetic iron oxide are present and scattered on the surface of the magnetic iron oxide. Consequently, when behaving as a "monomer," the silane compound more easily reacts with such functional groups. Accordingly, for the purpose of making most of the silane compound be present as a "monomer," the self-condensation rate is preferably 30% or less and more preferably 20% or less.

The self-condensation rate of the silane compound is the proportion of the self-condensed silane compound in the whole silane compound.

The hydrolysis of alkoxysilane is preferably performed as follows.

Specifically, an alkoxysilane is gradually fed to an aqueous solution or a mixed solution composed of an alcohol and water having a pH adjusted to be 4.0 or more and 6.5 or less, and is uniformly dispersed, for example, with a disper blade or the like. In this case, the liquid temperature of the dispersion liquid is preferably 35° C. or higher and 50° C. or lower. In general, the lower the pH is and the higher the liquid temperature is, the more easily the alkoxysilane is hydrolyzed. However, at the same time, the self-condensation also tends to occur, and hence it is difficult to achieve the moisture adsorption amount per unit area of the treated magnetic material, essential for the present invention, by using the silane compound in such a condition. In this way, it has been very difficult to suppress the self-condensation while the hydrolysis of the alkoxysilane is performed.

According to a diligent study made by the present inventors, even under the conditions that make the hydrolysis difficult (in other words, the conditions that make the self-condensation difficult), by using a dispersion apparatus capable of imparting a high shear such as a disper blade, the contact area between the alkoxysilane and water is increased, and the hydrolysis can be efficiently promoted. Consequently, while the hydrolysis rate is increased, the self-condensation can be suppressed.

In the present invention, it is preferable to treat the surface of the magnetic iron oxide with a silane compound in a gas phase. As has been described above, in the magnetic material of the present invention, a silane compound is adsorbed with the aid of hydrogen bonding to the surface of the magnetic iron oxide, dehydration of such adsorption enables the magnetic material to acquire strong chemical bonds. However, the hydrogen bonding formation between the silane compound and the surface of the magnetic iron oxide is a reversible reaction, and hence, the smaller is the content of water in the concerned system, with the larger amount of the silane compound the surface of the magnetic iron oxide can be treated. Along this line, the hydrophobicity of the treated magnetic material is extremely enhanced, and the rise of the charging of the toner is made faster. Moreover, preferably, the occurrence of ghost is made to less occur.

As an apparatus for surface-treating the magnetic iron oxide, heretofore known stirrers can be used. Specifically, preferable are apparatuses such as a Henschel mixer (manufactured by Mitsui Miike Engineering Corp.), a high speed mixer (manufactured by Fukae Powtec Co., Ltd.) and a hybridizer (manufactured by Nara Machinery Co., Ltd.).

The magnetic iron oxide is mainly composed of triiron tetraoxide, γ-iron oxide and others, and may contain the elements such as phosphorus, cobalt, nickel, copper, magnesium, manganese and aluminum.

The BET specific surface area of the magnetic material measured by the nitrogen adsorption method is preferably 2.0 $m^2/g$ or more and 20.0 $m^2/g$ or less, and more preferably 3.0 $m^2/g$ or more and 10.0 $m^2/g$ or less.

Examples of the shape of the magnetic material may include a polyhedron, an octahedron, a hexahedron, a sphere, a needle and a scale; preferable among these are the low-anisotropy shapes such as a polyhedron, an octahedron, a hexahedron and a sphere, for the purpose of enhancing the image density.

The volume average particle size (Dv) of the magnetic material is preferably 0.10 μm or more and 0.40 μm or less, from the viewpoint of the uniform dispersibility in the toner and the hue.

The volume average particle size (Dv) of the treated magnetic material can be measured with a transmission electron microscope. Specifically, after the toner particles to be observed are sufficiently dispersed in an epoxy resin, the resulting toner-containing resin is cured for 2 days in an atmosphere set at a temperature of 40° C. to yield a cured product. From the resulting cured product, a slice sample is prepared with a microtome, and in the photograph of the slice sample observed with a transmission electron microscope (TEM) at a magnification of 10,000× to 40,000×, the particle sizes of the 100 particles of the treated magnetic material in the field of vision are measured. Then, on the basis of the corresponding diameter of the circles equal to the projected areas of the treated magnetic material particles, the volume average particle size (Dv) is calculated. Alternatively, the particle size can also be measured with an image analyzer.

The treated magnetic material used in the toner of the present invention can be produced, for example, by the following method. Specifically, an aqueous solution containing ferrous hydroxide is prepared by adding an alkali, such as sodium hydroxide, to an aqueous solution of a ferrous salt, where the amount of the alkali is equivalent or more than equivalent to the amount of the iron component in the solution. While the pH of the prepared aqueous solution is being maintained at 7.0 or more, air is blown into the solution, and while the aqueous solution is being heated to 70° C. or higher, the oxidation reaction of ferrous hydroxide is performed, and thus first, seed crystals to be the cores of magnetic iron oxide particles are produced.

Next, to the seed crystal-containing slurry liquid is added an aqueous solution containing approximately 1 equivalent of ferrous sulfate based on the amount of the alkali previously added. While the pH of the liquid is being maintained at 5.0 or more and 10.0 or less and air is blown into the liquid, the reaction of the ferrous hydroxide is allowed to proceed, and thus magnetic iron oxide particles are grown wherein the seed crystals serve as the cores of the particles. In this case, the shape and the magnetic properties of the magnetic iron oxide can be controlled by optionally selecting the pH, the reaction temperature and the stirring conditions. The pH of the liquid is shifted toward the acidic side with the progress of the oxidation reaction, and it is preferable to maintain the pH of the liquid at 5.0 or more. After completion of the oxidation reaction, a source of silicon, such as sodium silicate, is added and the pH of the liquid is regulated at 5.0 or more and 8.0 or less. In this way, a coating layer of silicon is formed on the surface of the magnetic iron oxide particles. The magnetic iron oxide particles obtained as described above are filtered off, washed and dried according to the usual way, and thus the magnetic iron oxide can be obtained.

The amount of the silicon element present on the surface of the magnetic iron oxide can be controlled by regulating the amount of the source of silicon, such as sodium silicate, added after the completion of the oxidation reaction.

Next, the surface treatment with the silane compound essential to the present invention is performed. Specifically, the solution temperature of an aqueous solution, having a pH regulated at 3.0 or more and 6.5 or less, is controlled so as to be 35° C. or higher and 50° C. or lower. To this aqueous solution, an alkoxysilane is gradually fed, and the solution is uniformly stirred and dispersed by using a device such as a disper blade so as to undergo hydrolysis. The hydrolysate obtained in this way is added to the magnetic iron oxide, and the resulting mixture is uniformly mixed with a stirring-mixing machine, such as a high speed mixer or a Henschel mixer. The resulting mixture is dried and disintegrated at a temperature of 80° C. or higher and 160° C. or lower, and thus the surface-treated magnetic material can be obtained.

When the surface treatment is performed in a wet process, the dried product is redispersed after the completion of the oxidation reaction, or alternatively, the iron oxide material obtained by washing and filtration after the completion of the oxidation reaction is redispersed, without being dried, in another aqueous medium to be subjected to the surface treatment. Specifically, the surface treatment is performed as follows: while the redispersion liquid is sufficiently stirred, an alkoxysilane is added to the redispersion liquid, and the temperature of the redispersion liquid is increased after the hydrolysis so as to perform the surface treatment; or alternatively, after hydrolysis, the pH of the redispersion liquid is regulated to fall within the alkaline region so as to perform the surface treatment.

Examples of the silane compound usable for the surface treatment of the magnetic iron oxide include the silane compounds represented by the general Formula (I):

$$R_mSiY_n \quad (1)$$

(wherein R represents an alkoxy group or a hydroxyl group; m represents an integer of 1 to 3; Y represents an alkyl group or a vinyl group, and the alkyl group may have, as a substituent, a functional group, such as an amino group, a hydroxyl group, an epoxy group, an acryl group or a methacryl group; n represents an integer of 1 to 3 with the proviso that m+n=4.)

Examples of the silane compound represented by the general Formula (I) may include: vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyl-trimethoxysilane, n-octyltrimethoxysilane, n-octyl-triethoxysilane, n-decyltrimethoxysilane, hydroxypropyl-trimethoxysilane, n-hexadecyltrimethoxysilane and n-octadecyltrimethoxysilane, and the hydrolysates of these silanes.

When the above-described silane compounds are used, the treatment can be made with these silane compounds, each alone or in combinations of two or more thereof. When two or more of these silane compounds are used, the treatment may be made separately with each of such silane compounds, or alternatively, the treatment may be made at one time with all of such silane compounds.

When the magnetic iron oxide is dispersed in an aqueous solution of hydrochloric acid and dissolved until the dissolution proportion of the iron element reaches 5% by mass based on the total amount of the iron element contained in the magnetic iron oxide, the total amount of the alkali metals and the alkali earth metals eluted by that point of time is preferably 0.0050% by mass or less based on the magnetic iron oxide. When the total amount of the alkali metals and the alkali earth metals is 0.0050% by mass or less, it is meant that almost no alkali metals and almost no alkali earth metals are present on the surface of the magnetic iron oxide.

Preferably, when such metals are absent on and in the vicinity of the surface of the magnetic iron oxide, the treatment with the silane compound is more uniformly performed. According to the present inventors, the reasons for this are assumed as follows.

As has been described above, in the present invention, it is important that the hydroxyl groups and the silanol groups on the surface of the magnetic iron oxide form hydrogen bonds with the silane compound, followed by the dehydration to form chemical bonds between the silane compound and the magnetic iron oxide. However, if the alkali metals and the alkali earth metals are present in a large amount on the surface of the magnetic iron oxide, these metal elements are coordinated to the hydroxyl groups and the silanol groups, so as to impede the hydrogen bonding with the silane compound. This is probably because the hydroxyl groups and the silanol groups are anions, and in contrast the alkali metals and the alkali earth metals are cations, and hence these metals are easily electrically coordinated to the hydroxyl groups and the silanol groups. Thus, the uniformity of the treatment with the silane compound tends to be impaired. Therefore, in the present invention, the total amount of the alkali metals and the alkali earth metals present on and in the vicinity of the surface of the magnetic iron oxide is preferably 0.0050% by mass or less.

The amount of the alkali metals and the alkali earth metals present on the surface of the magnetic iron oxide can be controlled by performing ion-exchange with an ion exchange resin after the production of the magnetic iron oxide.

Specifically, as described above, the magnetic iron oxide produced in an aqueous system is filtered off and cleaned, and then again placed in water to prepare a slurry. To this slurry, an ion exchange resin is fed and then the slurry is stirred to remove the alkali metals and the alkali earth metals. Then, the ion exchange resin can be filtered out with a mesh.

In this case, the total amount of the alkali metals and/or the alkali earth metals present on the surface of the magnetic iron oxide can be controlled on the basis of the stirring period of time and the amount of the fed ion exchange resin.

In the present invention, the content of the magnetic material is preferably 20 parts by mass or more and 150 parts by mass or less based on 100 parts by mass of the binder resin.

The content of the magnetic material in the toner can be measured with the thermogravimetric analyzer TGA7 manufactured by Perkin-Elmer Corp. The measurement method is as follows. In a nitrogen atmosphere, the toner is heated at a temperature increase rate of 25° C./min, from normal temperature to 900° C. The percentage (%) of the mass reduction between 100° C. and 750° C. is defined as the amount of the binder resin and the remaining mass is approximately regarded as the amount of the treated magnetic material.

The weight average particle size (D4) of the toner of the present invention is preferably 3.0 μm or more and 12.0 μm or less and more preferably 4.0 μm or more and 10.0 μm or less. When the weight average particle size (D4) is 3.0 μm or more and 12.0 μm or less, a satisfactory fluidity is obtained to enable development to be performed faithfully to the latent image. Thus, a satisfactory image, excellent in dot reproducibility, can be obtained.

In the toner of the present invention, preferably the average circularity is 0.960 or more, and more preferably the mode circularity is 0.97 or more. When the average circularity of the toner is 0.960 or more, the shape of the toner is spherical or nearly spherical, the fluidity of the toner comes to be excellent, and the toner tends to attain a uniform triboelectric chargeability. Thus, preferably it is easier to maintain a high developability even in the latter half of continuous running.

The glass transition temperature (Tg) of the toner of the present invention is preferably 40.0° C. or higher and 70.0° C. or lower. When the glass transition temperature is 40.0° C. or higher and 70.0° C. or lower, preferably the storage stability and the durability of the toner can be improved while a satisfactory fixability is being maintained.

Examples of the binder resin used in the toner of the present invention include: homopolymers of styrene and derivatives thereof, such as polystyrene and polyvinyltoluene; styrene copolymers, such as styrene-propylene copolymer, styrene-vinyltoluene copolymer, styrene-vinylnaphthalene copolymer, styrene-methyl acylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; polymethyl methacrylate; polybutyl methacrylate; polyvinyl acetate; polyethylene; polypropylene; polyvinyl butyral; silicone resin; polyester resin; polyamide resin; epoxy resin; polyacrylic acid resin. These can be used each alone or in combinations of two or more thereof. Among these, styrene-acrylic resin is particularly preferable with respect to the properties, such as developability and fixability.

In the toner of the present invention, a charge controlling agent may also be mixed where necessary, for the purpose of improving the chargeability. As the charge controlling agent, heretofore known charge controlling agents can be used; charge controlling agents fast in speed and capable of stably maintaining a certain amount of charge are particularly preferable. When the toner is produced by using such a polymerization method as described below, charge controlling agents low in polymerization inhibition and having substantially no matter soluble into an aqueous dispersion medium are particularly preferable. Specific examples of the negative charge controlling agent of charge controlling agents include: metal compounds of aromatic carboxylic acids, such as salicylic acid, alkylsalicylic acid, dialkylsalicylic acid, naphthoic acid and dicarboxylic acids; metal salts or metal complexes of azo dyes or azo pigments; polymer type compounds having, in the side chains thereof, sulfonic acid groups or carboxylic acid groups; boron compounds; urea compounds; silicon compounds; and calixarenes. Specific examples of the positive charge controlling agents include: quaternary ammonium salts; polymer-type compounds having, in the side chains thereof, the quaternary ammonium salts; guanidine compounds; nigrosine compounds; and imidazole compounds.

The amount of such a charge controlling agent is determined by the type of the binder resin, the presence/absence of other additives, and the toner production method inclusive of the dispersion method, but is not uniquely limited. However, when the charge controlling agent is added internally to the toner particles, the charge controlling agent is used preferably in the range of 0.1 part by mass or more and 10.0 parts by mass or less and more preferably in the range of 0.1 part by mass or more and 5.0 parts by mass or less based on 100 parts by mass of the binder resin. When the charge controlling agent is added externally to the toner particles, the charge controlling agent is used preferably in the range of 0.005 part by mass or more and 1.000 part by mass or less and more preferably in the range of 0.01 part by mass or more and 0.30 part by mass or less based on 100 parts by mass of the toner particles.

In the toner of the present invention, a release agent may be mixed where necessary for the purpose of improving the fixability. As the release agent, all the heretofore known release agents can be used. Specific examples of the release agent include: petroleum based waxes such as paraffin wax, microcrystalline wax and petrolactum and derivatives thereof; montanwax and derivatives thereof; hydrocarbon waxes prepared by Fischer-Tropsch process and derivatives thereof; polyolefin waxes typified by polyethylene and derivatives thereof; natural waxes such as carnauba wax and candelilla wax and derivatives thereof; and ester waxes. The derivatives as referred to herein include oxides, block copolymers with vinyl-based monomers and graft modified products. As the ester wax, monofunctional ester waxes, bifunctional ester waxes, and multifunctional ester waxes such as tetrafunctional ester waxes and hexafunctional ester waxes can be used.

The endothermic peak top temperature of the release agent used in the present invention is preferably 50° C. or higher and 90° C. or lower. When the endothermic peak top temperature is 50° C. or higher and 90° C. or lower, the toner tends to be plasticized and the fixability is made better, and even when the toner is allowed to stand in an environment of high temperature and high humidity, preferably the bleeding or the like of the wax hardly occurs.

When a release agent is used in the toner of the present invention, the release agent is preferably used in an amount of 2 parts by mass or more and 30 parts by mass or less based on 100 parts by mass of the binder resin. When the used amount of the release agent is 2 parts by mass or more and 30 parts by mass or less, preferably the fixability is improved, and, at the same time, the storage stability of the toner tends to be satisfactory.

The toner of the present invention preferably has a core-shell structure, in order to improve the storage stability and further improve the developability thereof. This is because the presence of the shell layer uniformizes the surface properties of the toner, improves the fluidity of the toner and at the same time, uniformizes the chargeability of the toner.

Additionally, the high-molecular-weight shell uniformly covers the surface layer, and hence even a long term storage hardly causes the exudation of low-melting point substances and the like, leading to the improvement in the storage stability.

For this reason, it is preferable to use an amorphous high-molecular-weight substance in the shell layer, and from the viewpoint of the stability of the chargeability, the acid number of this amorphous substance is preferably 5.0 mg KOH/g or more and 20.0 mg KOH/or less.

Specific examples of the technique for forming the shell include a technique in which the fine particles for forming the shell are embedded into the core particles. Alternatively, when the toner is produced in an aqueous medium, it is possible to form the shell layer by attaching the fine particles for forming the shell to the core particles and by drying the resulting particles; when a dissolution suspension method or a suspension polymerization method is applied, it is possible to form the shell by making the high-molecular-weight substance be localized in the interface with water, namely, in the vicinity of the surface of the toner with the aid of the hydrophilicity of the high-molecular-weight substance for forming the shell. Moreover, it is also possible to form the shell by the so-called seed polymerization in which the monomer is swollen and polymerized on the surface of the core particles.

Examples of the high-molecular-weight substance for forming the shell include: homopolymers of styrene and derivatives thereof, such as polystyrene and polyvinyltoluene; styrene copolymers, such as styrene-propylene copolymer, styrene-vinyltoluene copolymer, styrene-vinylnaphthalene copolymer, styrene-methyl acylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; polymethyl methacrylate; polybutyl methacrylate; polyvinyl acetate; polyethylene; polypropylene; polyvinyl butyral; silicone resin; polyester resin; styrene-polyester copolymer; polyacrylate-polyester copolymer; polymethacrylate-polyester copolymer; polyamide resin; epoxy resin; polyacrylic acid resin; terpene resin; and phenolic resin. These can be used each alone or as mixtures of two or more thereof. Into these polymers, functional groups such as amino group, a carboxylic group, a hydroxyl group, a sulfonic acid group, a glycidyl group and a nitrile group may also be introduced.

When the toner is produced by the suspension polymerization method, these resins may be added in a total amount of preferably 1.0 part by mass or more and 30.0 parts by mass or less and more preferably 1.0 part by mass or more and 20.0 parts by mass or less based on 100 parts by mass of the polymerizable monomer.

Among these resins, polyester is particularly preferable because the above-described effects are remarkably developed. As the polyester resin used in the present invention, a saturated polyester resin and an unsaturated polyester resin or both of these can be optionally selected to be used.

The high-molecular-weight substance that forms the shell may preferably have a number average molecular weight (Mn) of 2,500 or more and 20,000 or less. The number average molecular weight (Mn) of 2,500 or more and 20,000 or less preferably enables to improve the developability, the blocking resistance and the durability without impairing the fixability. The number average molecular weight (Mn) can be measured by GPC.

The toner of the present invention can be produced by any heretofore known method. When the toner is produced by a pulverization method, the components essential for the toner, such as a binder resin, a treated magnetic material and a release agent, and other additives are sufficiently mixed together with a mixer such as a Henschel mixer or a ball mill. The resulting mixture is then melt-kneaded with a heat kneader such as a heat roll, a kneader or an extruder to disperse or dissolve the toner materials, then the melt-kneaded mixture is cooled for solidification, pulverized, then classified, surface-treated where necessary, and thus magnetic toner particles can be obtained. The classification and the surface treatment may be performed in any order. From the viewpoint of the preparation efficiency, it is preferable to use a multi-fraction classifier in the classification step.

The toner of the present invention can be produced by a pulverizing method as described above; however, the toner obtained by such a pulverizing method undergoes the exposure of the magnetic material to the surface of the toner. Consequently, uniform chargeability is hardly obtained, and the degradation of the density tends to occur when the toner is allowed to stand after continuous running.

The magnetic toner particles of the present invention is preferably produced in an aqueous medium by a method such as a dispersion polymerization method, an association aggregation method, a dissolution suspension method or a suspension polymerization method; among these methods, the suspension polymerization method is more preferable.

In the suspension polymerization method, first the polymerizable monomer and the treated magnetic material (further, where necessary, a polymerization initiator, a crosslinking agent, a charge controlling agent, and other additives) are uniformly dissolved or dispersed to yield a polymerizable monomer composition; next, the polymerizable monomer composition is dispersed with an appropriate stirrer in a dispersion stabilizer-containing continuous phase (for example, aqueous phase) and, at the same time, is allowed to undergo polymerization reaction to yield an toner having an intended particle size. In the toner (hereinafter, also referred to as "polymerized toner") obtained by the suspension polymerization method, the shapes of the individual toner particles are nearly uniformly spherical, and hence preferably the charge amount distribution is relatively uniform.

In the production of the toner based on the suspension polymerization, examples of the polymerizable monomer constituting the polymerizable monomer composition include the following.

Examples of the polymerizable monomer include: styrene monomers, such as styrene, o-methylstyrene, m-methylstyrene, p-methylstyrene, p-methoxystyrene and p-ethylstyrene; acrylic acid esters, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic acid esters, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers, such as acrylonitrile, methacrylonitrile and acrylamide. These monomers can be used each alone or as mixtures thereof. Among the above listed monomers, preferably styrene or a styrene derivative is used alone, or is used as mixtures with the other monomers, from the viewpoint of the development properties and the durability of the toner.

As the polymerization initiator used in the production by polymerization of the toner of the present invention, an initiator having a half life, at the time of polymerization reaction, of 0.5 hour or more and 30.0 hours or less is preferable. The amount of the polymerization initiator added is preferably 0.5 part by mass or more and 20.0 parts by mass or less in relation of 100 parts by mass of the polymerizable monomer.

As the polymerization initiator, heretofore known ones can be used; specifically, polymerization initiators, such as azo initiators and peroxide initiators, can be used.

In the method for producing the toner of the present invention by polymerization, in general, the polymerizable monomer composition is prepared by appropriately adding the above-described toner composition and others and by uniformly dissolving or dispersing with a disperser such as a homogenizer, a ball mill or an ultrasonic disperser, and the resulting polymerizable monomer composition is suspended in a dispersion stabilizer-containing aqueous medium. In this case, when an intended toner particle size is obtained in a time as short as possible by using a disperser such as a high speed stirrer or an ultrasonic disperser, the particle size distribution of the obtained toner particles is sharp. The timing of the addition of the polymerization initiator is such that the polymerization initiator may be added in the polymerizable monomer composition at the same time when other additives are added in the polymerizable monomer, or alternatively may be mixed in the polymerizable monomer immediately before the polymerizable monomer composition is suspended in an aqueous medium. Yet alternatively, immediately after the granulation and before the start of the polymerization reaction, the polymerization initiator dissolved in the polymerizable monomer or in a solvent can also be added.

After the granulation, stirring may be performed by using a common stirrer to such an extent that the state of being particles is maintained and the floating and sedimentation of the particles are prevented.

In the production of the toner of the present invention, heretofore known surfactants, organic dispersants and inorganic dispersants can be used as the dispersion stabilizer. Among these, inorganic dispersants hardly produce harmful ultrafine powders, acquire the dispersion stability through the steric hindrance thereof and hence the stability thereof is high even when the reaction temperature is varied; the cleaning of the inorganic dispersants is easy, and the inorganic dispersants hardly adversely affect the toner and hence are preferably used. Examples of such inorganic dispersants include: multivalent metal salts of phosphoric acid, such as calcium triphosphate, magnesium phosphate, aluminum phosphate, zinc phosphate and hydroxyapatite; carbonates, such as calcium carbonate and magnesium carbonate; inorganic salts, such as calcium metasilicate, calcium sulfate and barium sulfate; and inorganic compounds, such as calcium hydroxide, magnesium hydroxide and aluminum hydroxide.

These inorganic dispersants are preferably used in an amount of 0.20 part by mass or more and 20 parts by mass or less based on 100 parts by mass of the polymerizable monomer. The above listed dispersion stabilizers may be used each alone or in combinations of two or more thereof. Further, in addition to the dispersion stabilizer, surfactants may also be used in combination.

In the process of polymerizing the polymerizable monomer, the polymerization temperature is set at a temperature of 40° C. or higher, in general, 50° C. or higher and 90° C. or lower.

After the completion of the polymerization of the polymerizable monomer, the obtained polymer particles are filtered, cleaned and dried by heretofore known methods, and thus the toner particles are obtained. The toner of the present invention can be obtained by mixing such an inorganic fine powder as described below, where necessary, with the toner particles so as to attach to the surface of the toner particles. A classification step introduced into the production step (before the mixing of the inorganic fine powder) also enables the removal of the coarse powders and fine powders contained in the toner particles.

The toner of the present invention comprises an inorganic fine powder; the number average primary particle size (D1) of the inorganic fine powder is preferably 4 nm or more and 80 nm or less, and more preferably 6 nm or more and 40 nm or less.

When the number average primary particle size (D1) of the inorganic fine powder is 4 nm or more and 80 nm or less, the fluidity of the toner is excellent, and a uniform chargeability can be obtained, and at the same time, uniform images can be obtained even in a long term use.

In the present invention, the method for measuring the number average primary particle size (D1) of the inorganic fine powder is performed by using the magnified photograph of the toner taken with a scanning electron microscope.

As the inorganic fine powder used in the present invention, silica, titanium oxide, alumina and the like fine powders can be used. As the silica fine powder, for example, both of dry silica produced by vapor phase oxidation of silicon halide, called dry-method silica or fumed silica and wet silica produced from liquid glass or the like can be used. Dry silica is more preferable because the amount of the silanol groups present on the surface and inside the silica fine powder is small and the amounts of production residuals, such as $Na_2O$ and $SO_3^{2-}$, are small. In the case of dry silica, by using other metal halides, such as aluminum chloride and titanium chloride, together with silicon halide in the production process of dry silica, composite fine powders composed of silica and other metal oxides can also be obtained, and such composite fine powders are also included in dry silica.

In the present invention, the amount of the inorganic fine powder added is preferably 0.1 part by mass or more and 5.0 parts by mass or less based on 100 parts by mass of the magnetic toner particles. When the amount of the inorganic fine powder falls within the above-described range, preferably satisfactory fluidity can be imparted to the toner and the fixability is not impaired.

The content of the inorganic fine powder can be quantitatively determined by applying fluorescence X-ray analysis and by using a calibration curve prepared with standard samples.

Next, an example of an image forming apparatus capable of suitably using the toner of the present invention is described with reference to FIG. 1. In FIG. 1, around an electrostatic image bearing member (hereinafter, also referred to as a "photosensitive member") 100, a charging roller 117, a development device 140 having a toner carrier 102, a transfer charge roller 114, a cleaner 116 and a register roller 124 and others are provided. The electrostatic latent image bearing member 100 is charged by the charging roller 117, for example, at −600 V (the applied voltage is, for example, an alternating current voltage of 1.85 kVpp or a direct current voltage of −620 Vdc). Exposure is performed by irradiating the electrostatic latent image bearing member 100 with the laser light 123 from a laser generating device 121, and thus an electrostatic latent image corresponding to the target image is formed. The electrostatic latent image on the electrostatic latent image bearing member 100 is developed with a one-component toner by the development device 140 to yield a toner image, the toner image is transferred to an image transfer material by the transfer roller 114 abutting to the electrostatic latent image bearing member through the image transfer material. The image transfer material bearing the toner image is conveyed to a fixation device 126 by a conveying belt 125 or the like and the image is fixed on the image transfer material. The toner partially remaining on the electrostatic latent image bearing member is cleaned off by a cleaner 116.

Next, the measurement methods for the individual physical properties according to the present invention are described.

(1) Average Particle Size and Particle Size Distribution of the Toner

The weight average particle size (D4) of the toner of the present invention is determined by performing a measurement with a high precision particle size distribution measurement apparatus "Coulter Counter, Multisizer 3" (trade mark, manufactured by Beckman Coulter, Inc.) based on the pore electric resistance method, equipped with a 100-μm aperture tube and an appended dedicated software "Beckman-Coulter Multisizer 3, Version 3.51" (produced by Beckman Coulter, Inc.) for setting the measurement conditions and analyzing the measured data, at an effective measurement channel number of 25,000, the measurement being followed by analysis of the measured data with the dedicated software to calculate the weight average particle size (D4).

As the electrolyte aqueous solution used for the measurement, a solution prepared by dissolving guaranteed grade sodium chloride in ion-exchanged water so as for the concentration of the solution to be approximately 1% by mass, such as "ISOTON II" (manufactured by Beckman-Coulter, Inc.) can be used.

Before performing the measurement and analysis, the setting of the dedicated software is made as follows.

In the "Screen for Altering Standard Operation Method (SOM)" of the dedicated software, the total count number of the control mode is set at 50,000 particles, the number of measurement runs is set at one, the Kd value is set at a value obtained by using the "10.0-μm standard particles" (manufactured by Beckman-Coulter, Inc.). By pushing the threshold value/noise level measurement button, the threshold value and the noise level are automatically set. The current is set at 1,600 μA, the gain is set at 2, the electrolyte solution is set at ISOTON II, and the flush of the aperture tube after measurement is marked.

In the "Screen for Setting Pulse to Particle Size Conversion" of the dedicated software, the bin interval is set at the logarithmic particle size, the particle size bin is set at the 256 particle size bin, and the particle size range is set at a range from 2 μm to 60 μm.

The specific measurement method is as follows.

1-1) In a 250-ml round-bottom glass beaker for exclusive use for Multisizer 3, approximately 200 ml of the electrolyte aqueous solution is placed, the beaker is set on a sample stand, and the solution is stirred with a stirrer rod at 24 revolutions/second in an anticlockwise manner. With the function of "flush of aperture" of the analysis software, the dirt and the air bubbles inside the aperture tube are removed.

1-2) In a 100-ml flat bottom glass beaker, approximately 30 ml of the electrolyte aqueous solution is placed, and in this beaker, as a dispersant, approximately 0.3 ml of a diluted solution prepared by diluting "Contaminon N" by a factor of 3 in terms of mass with ion-exchanged water is additionally placed, wherein "Contaminon N" is a 10% by mass aqueous solution of a neutral detergent having a pH of 7, for use in washing precision measurement devices, manufactured by Wako Pure Chemical Industries Ltd., the neutral detergent being composed of a nonionic surfactant, an anionic surfactant and an organic builder.

1-3) A predetermined amount of ion-exchanged water is placed in a water tank of an ultrasonic dispersion device "Ultrasonic Dispersion System Tetora 150" (manufactured by Nikkaki-Bios Co., Ltd.) having an electric output power of 120 W, equipped with two built-in oscillators of an oscillation frequency of 50 kHz with a phase shift of 180 degrees therebetween, and then approximately 2 ml of above-mentioned Contaminon N is placed in this water tank.

1-4) The beaker in the above mentioned 1-2) is set in the beaker fixing hole of the ultrasonic dispersion device, and then the ultrasonic dispersion device is made to operate. Then, the height of the beaker is adjusted in such a way that the resonance state of the liquid surface of the electrolyte aqueous solution in the beaker comes to be maximum.

1-5) Under the condition that the electrolyte aqueous solution in the beaker of the above-described 1-4) is being irradiated with ultrasonic wave, approximately 10 mg of the toner is added to and dispersed in the electrolyte aqueous solution, in a small amount at a time. Then, the solution continues to be subjected to an ultrasonic dispersion treatment further for 60 seconds. In performing the ultrasonic dispersion, the water temperature of the water tank is appropriately regulated to be 10° C. or higher and 40° C. or lower.

1-6) Into the round-bottom beaker described in the above-described (1) placed in the sample stand is dropwise added by using a pipette the electrolytic aqueous solution described in 1-5) in which a toner is dispersed, so as for the measured concentration to be approximately 5%. Then, the measurement is performed until the number of the measured particles reaches 50,000.

1-7) The measurement data are analyzed with the dedicated software attached to the apparatus to calculate the weight average particle size (D4). When the graph/% by volume is set in the dedicated software, an "average diameter" of the analysis/volume statistical value (arithmetic average) in the screen is the weight average particle diameter (D4).

(2) Moisture Adsorption Amount per Unit Area of Treated Magnetic Material

The moisture adsorption amount per unit area of the treated magnetic material used in the present invention is calculated by measuring the BET specific surface area and the moisture adsorption amount of the treated magnetic material used and using the numerical values thus obtained in the measurement. Specifically, the moisture adsorption amount per unit area of the treated magnetic material is calculated by dividing the moisture adsorption amount per unit mass obtained in the below-described 2-2) by the BET specific surface area obtained in the below-described 2-1).

2-1) BET Measurement of Treated Magnetic Material

The measurement of the BET specific surface area is performed with a degassing apparatus VacuPrep 061 (manufactured by Micromeritics Corp.) and a BET analyzer Gemini 2375 (manufactured by Micromeritics Corp.). The BET specific surface area in the present invention is a value based on the multipoint BET specific surface measurement. Specifically, such a measurement is performed according to the following procedure.

The mass of a blank sample cell is measured, and then the treated magnetic material is weighed out in an amount of 2.0 g and packed in the sample cell. The sample cell packed with the sample is set in the degassing apparatus, and is degassed at room temperature for 12 hours. After completion of the degassing, the mass of the whole sample cell is measured, and the accurate mass of the sample is calculated from the difference between the mass of the whole sample cell and the mass of the blank sample cell. Next, a blank sample cell is set in each of the balance port and the analysis port of the BET measurement apparatus. A Dewar flask containing liquid nitrogen is set at a predetermined position, and a saturated vapor pressure (P0) is measured by a P0 measurement command. After completion of the measurement of the P0, the sample cell prepared by degassing is set in the analysis port, and the sample mass and the P0 are input. Then, measurement is started by a BET measurement command. Subsequently, the BET specific surface area is automatically calculated.

2-2) Measurement of Moisture Adsorption Amount of Treated Magnetic Material

In the measurement of the moisture adsorption amount, first the treated magnetic material is allowed to stand for 72 hours in an environment of a temperature of 30° C. and a humidity of 80%, and then the measurement is performed with the following measurement apparatus.

In the measurement of the moisture adsorption amount, a moisture measurement apparatus manufactured by Hiranuma Sangyo Corp. is used. Specifically, a trace moisture measurement apparatus AQ-2100, an automatic heat-vaporization moisture measurement apparatus AQS-2320 and an automatic moisture vaporization apparatus SE320 are used in combination; the amount of moisture in the treated magnetic material is measured by the Karl-Fischer coulometric titration method.

Hereinafter, the measurement conditions are described. As the measurement scheme, an interval control scheme is adopted. The interval is set at 40 seconds, the heating temperature is set at 120° C. and the amount of the treated magnetic material fed is set at 2.0 g. This measurement yields the moisture adsorption amount of adsorbed moisture per unit mass.

(3) Method for measuring Hydrolysis Rate of Silane Compound

The hydrolysis rate of a silane compound is described. Application of hydrolysis treatment to an alkoxysilane produces a mixture composed of a hydrolysate, an unhydrolyzed substance and a condensate. The ratio of the hydrolysate in the obtained mixture is described below. The mixture corresponds to the above-described silane compound.

First, the hydrolysis reaction of alkoxysilane is described by taking methoxysilane as an example. When methoxysilane is hydrolyzed, the methoxy group turns into a hydroxyl group and methanol is produced. Accordingly, from the quantity ratio between the methoxy group and methanol, the degree of progression of the hydrolysis can be found. In the present invention, the hydrolysis rate is obtained by measuring the quantity ratio with the aid of $^1$H-NMR (nuclear magnetic resonance). By talking methoxysilane as an example, the specific measurement procedure and calculation procedure are described blow.

First, the $^1$H-NMR (nuclear magnetic resonance) of methoxy silane before being subjected to the hydrolysis treatment is measured by using deuterated chloroform to identify the peak position ascribable to the methoxy group. Then, methoxysilane is subjected to a hydrolysis treatment to be converted into the silane compound; the aqueous solution of the silane compound, immediately before the addition thereof to the untreated magnetic material, is made to have a pH of 7.0 and a temperature of 10° C. so as to terminate the hydrolysis reaction. The water content of the resulting aqueous solution is removed to yield a dried solid product of the silane compound. A small amount of deuterated chloroform is added to the dried solid product, and the $^1$H-NMR spectrum of the dried solid product is measured. The peak ascribable to the methoxy group in the obtained spectrum is determined with reference to the beforehand identified peak position. The peak area ascribable to the methoxy group is represented by A and the peak area ascribable to the methyl group of methanol is represented by B, and the hydrolysis rate is obtained by the following formula.

$$\text{Hydrolysis rate}(\%)=(B/(A+B))\times 100$$

The $^1$H-NMR measurement conditions are set as follows.

Measurement apparatus: FT NMR spectrometer, JNM-EX400 (manufactured by JEOL Ltd.)

Measurement frequency: 400 MHz

Pulse condition: 5.0 μs

Frequency range: 10,500 Hz

Cumulated number: 1,024 times

Measurement temperature: 40° C.

(4) Measurement Method for Self-Condensation Rate of Silane Compound

The self-condensation rate for the silane compound is the ratio of the self-condensate (siloxane) to the total components in the silane compound. Specifically, the self-condensation rate is measured by gel permeation chromatography (GPC) as follows.

First, an aqueous solution of the silane compound, immediately before the addition thereof to the untreated magnetic material, is made to have a pH of 7.0 and a temperature of 10° C. so as to terminate the hydrolysis reaction. For the pH adjustment, acetic acid, triethylamine and ion-exchanged water are used. Then, acetonitrile is added to the aqueous solution of silane compound so as for the silane compound concentration to be 10% by volume, and the GPC measurement of the obtained solution is performed.

The GPC measurement conditions are shown as follows.

Apparatus: HLC 8120 GPC (detector: RI) (manufactured by Tohso Corp.)

Column: GF-3,0-HQ (manufactured by Showa Denko K.K.)

Flow rate: 1.0 ml/min

Oven temperature: 40.0° C.

Sample injection amount: 25 μL

Next, the method for calculating the self-condensation rate from the GPC measurement results of the silane compound is described below.

Figure 2A:
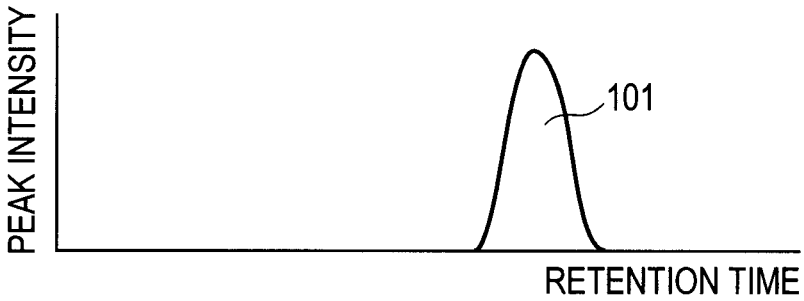
FIGS. 2A and 2B are schematic GPC charts of alkoxysilane.
Figure 2B:
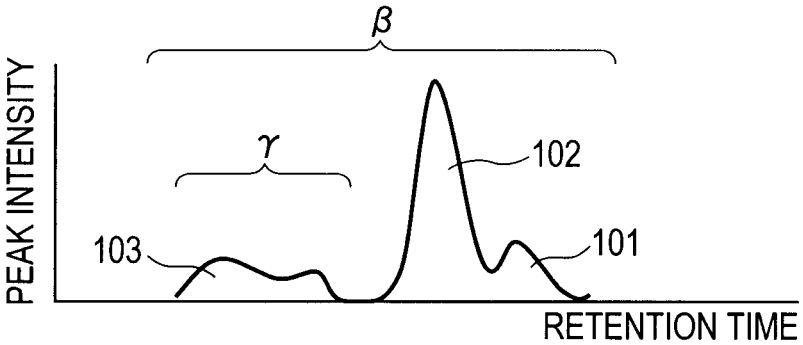

When the silane compound is subjected to the GPC measurement, charts schematically illustrated in FIGS. 2A and 2B are obtained. FIG. 2A shows the chart before the hydrolysis treatment, and FIG. 2A shows charts after the hydrolysis treatment. To be more concrete, FIG. 2A illustrates the GPC chart obtained by measuring the alkoxysilane before being subjected to the hydrolysis treatment, and FIG. 2A illustrates the GPC chart obtained under the condition that the alkoxysilane, the hydrolysate and the self-condensate are present as a result of performing the hydrolysis treatment of the alkoxysilane, along with the schematically illustrated assignment of the peaks. In FIGS. 2A and 2B, numeral 101 denotes a peak ascribable to the alkoxysilane; 102*a* peak ascribable to the hydrolyzed alkoxysilane; and 103*a* peak ascribable to siloxane.

In the resulting GPC chart, the total area of the peaks ascribable to the silane compounds (alkoxysilane, hydrolyzed alkoxysilane and siloxane) is represented by β, and the area of the peak ascribable to the self-condensate (siloxane) is represented by γ. The self-condensation rate is defined by using β and γ as follows.

$$\text{Self-condensation rate}(\%)=100\times(\gamma/\beta)$$

(5) Dissolution Proportion of Iron Element, and Contents of Silicon, Alkali Metals and Alkali Earth Metals In the present invention, the dissolution proportion of the iron element in the magnetic iron oxide and the contents of the metal elements other than iron based on the dissolution proportion of the iron element can be obtained by the following method. Specifically, in a 5-liter beaker, 3 liter of deionized water is placed, and heated with a water bath to 50° C. To the heated deionized water, 25 g of the magnetic iron oxide is added and stirred. Then, guaranteed grade hydrochloric acid is added so as to prepare a 3 mol/L aqueous solution of hydrochloric acid and thus magnetic iron oxide is dissolved. During the time period between the start of the dissolution and the time point where the magnetic iron oxide is completely dissolved and the solution comes to be transparent, sampling is performed ten and a few times, and each time, filtration is performed with a 0.1 μm membrane filter and the filtrate is collected. Each time, the filtrate is subjected to a plasma emission spectroscopy (ICP) to quantitatively determine the iron element and the metal elements other than the iron element, and the iron element dissolution proportion of each of the samples is obtained by the following formula.

$$\text{Dissolution proportion of iron element}=(\text{Iron element concentration in sample/iron element concentration in complete dissolution})\times 100$$

For each of the samples, the contents of silicon, alkali metals and alkali earth metals are obtained, and from the relation between the dissolution proportion of the iron element obtained by the above-described measurement and the contents of the elements then detected, the contents of silicon, alkali metals and alkali earth metals present until the dissolution proportion of the iron element reaches 5% are obtained.

EXAMPLES

Hereinafter, the present invention is described more specifically with reference to Production Examples and Examples, but these are not intended to limit the present invention. In the following compositions, the proportions given in parts are all given in parts by mass.

(Production of Magnetic Iron Oxide 1)

In 50 liters of an aqueous solution of ferrous sulfate containing $Fe^{2+}$ in an amount of 2.0 mol/L, 55 liters of a 4.0 mol/L aqueous solution of sodium hydroxide was mixed and stirred, to yield a ferrous salt aqueous solution containing ferrous hydroxide colloid. While the aqueous solution was being maintained at 85° C. and air was being blown into the solution at a rate of 20 L/min, oxidation reaction was performed to yield a core particle-containing slurry.

The obtained slurry was filtered with a filter press and washed, and then the core particles were again dispersed in water to prepare a slurry. To the slurry solution, sodium silicate was added in a content of 0.10% by mass, in terms of silicon, based on 100 parts of the core particles, and the pH of the slurry solution was adjusted to 6.0 and the slurry solution was stirred to yield magnetic iron oxide particles having a silicon-rich surface. The obtained slurry was filtered with a filter press, washed, and converted into a slurry with ion exchanged water. To the resulting slurry solution (solid content: 50 g/L), 500 g (10% by mass based on the magnetic iron oxide) of an ion exchange resin SK 110 (Mitsubishi Chemical Corp.) was fed and stirred for 2 hours to perform ion exchange. Subsequently, the ion exchange resin was filtered out with a mesh, and the slurry was filtered with a filter press, washed, dried and disintegrated to yield magnetic iron oxide 1 having a volume average particle size of 0.21 μm.

(Production of Magnetic Iron Oxide 2)

Magnetic iron oxide 2 having a volume average particle size of 0.21 μm was obtained in the same manner as in the production of the magnetic iron oxide 1 except that the amount of sodium silicate was altered to 0.03 part.

(Production of Magnetic Iron Oxide 3)

Magnetic iron oxide 3 having a volume average particle size of 0.21 μm was obtained in the same manner as in the production of the magnetic iron oxide 1 except that the amount of sodium silicate was altered to 0.05 part.

(Production of Magnetic Iron Oxide 4)

Magnetic iron oxide 4 having a volume average particle size of 0.21 μm was obtained in the same manner as in the production of the magnetic iron oxide 1 except that the amount of sodium silicate was altered to 0.50 part.

(Production of Magnetic Iron Oxide 5)

Magnetic iron oxide 5 having a volume average particle size of 0.21 μm was obtained in the same manner as in the production of the magnetic iron oxide 1 except that the amount of sodium silicate was altered to 0.55 part.

(Production of Magnetic Iron Oxide 6)

Magnetic iron oxide 6 having a volume average particle size of 0.21 μm was obtained in the same manner as in the production of the magnetic iron oxide 1 except that the amount of sodium silicate was altered to 0.50 part and the time period of the stirring after the feeding of the ion exchange resin was altered to 1 hour.

(Production of Magnetic Iron Oxide 7)

Magnetic iron oxide 7 having a volume average particle size of 0.21 μm was obtained in the same manner as in the production of the magnetic iron oxide 1 except that the amount of sodium silicate was altered to 0.50 part and the time period of the stirring after the feeding of the ion exchange resin was altered to 45 minutes.

(Production of Magnetic Iron Oxide 8)

Magnetic iron oxide 8 having a volume average particle size of 0.21 μm was obtained in the same manner as in the production of the magnetic iron oxide 1 except that the amount of sodium silicate was altered to 0.50 part and no ion exchange resin was fed.

(Preparation of Silane Compound 1)

To 60 parts of ion exchanged water, 40 parts of isobutyltrimethoxysilane was dropwise added under stirring. Then, while the aqueous solution was being maintained at a pH of 5.3 and at a temperature of 40° C., the aqueous solution was dispersed for 2.0 hours with a disper blade at a circumferential speed of 0.46 m/s and thus the hydrolysis was performed. Then, the aqueous solution was made to have a pH of 7.0 and was cooled to 10° C. so as to terminate the hydrolysis reaction. Thus, there was obtained an aqueous solution containing the silane compound 1 having a hydrolysis rate of 95% and a self-condensation rate of 16%.

(Preparation of Silane Compound 2)

An aqueous solution was obtained which contains silane compound 2 having a hydrolysis rate of 70% and a self-condensation rate of 12% in the same manner as in the preparation of the silane compound 1 except that the time period of the dispersion with the disper blade was altered to 1.5 hours.

(Preparation of Silane Compound 3)

An aqueous solution was obtained which contains silane compound 3 having a hydrolysis rate of 50% and a self-condensation rate of 9% in the same manner as in the preparation of the silane compound 1 except that the time period of the dispersion with the disper blade was altered to 1.0 hour.

(Preparation of Silane Compound 4)

An aqueous solution was obtained which contains silane compound 4 having a hydrolysis rate of 45% and a self-condensation rate of 6% in the same manner as in the preparation of the silane compound 1 except that the time period of the dispersion with the disper blade was altered to 45 minutes.

(Preparation of Silane Compound 5)

To 60 parts of ion exchanged water, 40 parts of isobutyltrimethoxysilane was dropwise added under stirring. Then, while the aqueous solution was beingmaintained at a pH of 3.2 and at a temperature of 48° C., the aqueous solution was dispersed for 15 minutes with a disper blade at a circumferential speed of 0.46 m/s and thus the hydrolysis was performed. Then, the aqueous solution was made to have a pH of 7.0 and was cooled to 10° C. so as to terminate the hydrolysis reaction. Thus, there was obtained an aqueous solution containing silane compound 5 having a hydrolysis rate of 44% and a self-condensation rate of 21%.

(Preparation of Silane Compound 6)

To 60 parts of ion exchanged water, 40 parts of isobutyltrimethoxysilane was dropwise added under stirring. Then, while the aqueous solution was being maintained at a pH of 2.8 and at a temperature of 52° C., the aqueous solution was dispersed for 15 minutes with a disper blade at a circumferential speed of 0.46 m/s and thus the hydrolysis was performed. Then, the aqueous solution was made to have a pH of 7.0 and was cooled to 10° C. so as to terminate the hydrolysis reaction. Thus, there was obtained an aqueous solution containing silane compound 6 having a hydrolysis rate of 46% and a self-condensation rate of 32%.

(Preparation of Silane Compound 7)

To 60 parts of ion exchanged water, 40 parts of isobutyltrimethoxysilane was dropwise added under stirring. Then, while the aqueous solution was being maintained at a pH of 5.3 and at a temperature of 40° C., the aqueous solution was dispersed for 60 minutes with a propeller blade at a circumferential speed of 0.10 m/s and thus the hydrolysis was performed. Then, the aqueous solution was made to have a pH of 7.0 and was cooled to 10° C. so as to terminate the hydrolysis reaction. Thus, there was obtained an aqueous solution containing silane compound 7 having a hydrolysis rate of 45% and a self-condensation rate of 34%.

(Preparation of Titanate Compound)

To 60 parts of ion exchanged water, 40 parts of a titanium coupling agent, Plenact TTS (manufactured by Ajinomoto Fine-Techno Co., Inc.) was dropwise added under stirring. Then, while the aqueous solution was being maintained at a pH of 5.3 and at a temperature of 40° C., the aqueous solution was dispersed for 2.0 hours with a disper blade at a circumferential speed of 0.46 m/s and thus the hydrolysis was performed. Then, the aqueous solution was made to have a pH of 7.0 and was cooled to 10° C. so as to terminate the hydrolysis reaction. Thus, there was obtained an aqueous solution containing a titanate compound having a hydrolysis rate of 70%.

(Production of Treated Magnetic Material 1)

In a high speed mixer (Model LFS-2, manufactured by Fukae Powtec Co., Ltd.), 100 parts of the magnetic iron oxide 1 was placed, and 8.5 parts of an aqueous solution containing the silane compound 1 was dropwise added over 2 minutes under stirring at a number of revolutions of 2,000 rpm. Then, the resulting mixture was mixed and stirred for 3 minutes. Then, the mixture was dried at 120° C. for 1 hour, and at the same time, the condensation reaction of the silane compound was allowed to proceed. Then, the dried product was disintegrated and made to pass through a sieve of 100 μm in opening, and thus treated magnetic material 1 was obtained. The physical properties of the treated magnetic material 1 are shown in Table 1.

(Production of Treated Magnetic Materials 2 to 9 and 11 to 13)

Treated magnetic materials 2 to 9 and 11 to 13 were obtained in the same manner as in the production of the treated magnetic material 1 except that the magnetic iron oxide, the silane compound and the addition amount of the silane compound were altered as described in Table 1. The physical properties of the obtained treated magnetic materials are shown in Table 1.

(Production of Treated Magnetic Material 10)

In a high speed mixer (Model LFS-2, manufactured by Fukae Powtec Co., Ltd.), 100 parts of the magnetic iron oxide 4 was placed, and 8.5 parts of an aqueous solution containing the silane compound 4 was dropwise added over 2 minutes under stirring at a number of revolutions of 2,000 rpm. Then, the resulting mixture was mixed and stirred for 3 minutes. Then, the mixture was dried at 170° C. for 2 hours, and at the same time, the condensation reaction of the silane compound was allowed to proceed. Then, the dried product was disintegrated and made to pass through a sieve of 100 μm in opening, and thus treated magnetic material 10 was obtained. The physical properties of the treated magnetic material 10 are shown in Table 1.

(Production of Treated Magnetic Material 14)

In the same manner as in the production of the magnetic iron oxide 8, magnetic iron oxide particles having silicon-rich surface were obtained. Then, by performing filtration, a hydrous sample was once taken out. In this case, a small amount of the hydrous sample was sampled and subjected to a measurement of the water content. Next, the hydrous sample was placed, without drying, in another aqueous medium, and stirred and redispersed while the slurry was circulated. Then, 8.5 parts of the silane compound 4 based on 100 parts of the magnetic iron oxide (the amount of the magnetic iron oxide was calculated as the value derived by subtracting the water content from the amount of the hydrous sample) was added under stirring, and the surface treatment was performed with the pH of the dispersion liquid set at 8.6. The obtained magnetic material was filtered with a filter press, washed with water, and then dried at 120° C. for 1 hour, and the obtained particles were disintegrated to yield magnetic iron oxide 14 having a volume average particle size of 0.21 μm. The physical properties of the treated magnetic material 14 are shown in Table 1.

(Production of Treated Magnetic Material 15)

In a high speed mixer (Model LFS-2, manufactured by Fukae Powtec Co., Ltd.), 100 parts of the magnetic iron oxide 1 was placed, and 8.5 parts of the aqueous solution containing the titanate compound was dropwise added over 2 minutes under stirring at a number of revolutions of 2,000 rpm. Then, the resulting mixture was mixed and stirred for 3 minutes. Then, the mixture was dried at 120° C. for 1 hour, and at the same time, the condensation reaction of the titanate compound was allowed to proceed. Then, the dried product was disintegrated and made to pass through a sieve of 100 μm in opening, and thus treated magnetic material 15 was obtained. The physical properties of the treated magnetic material 15 are shown in Table 1.

(Production of Treated Magnetic Material 16)

In a high speed mixer (Model LFS-2, manufactured by Fukae Powtec Co., Ltd.), 100 parts of the magnetic iron oxide 1 was placed, and 3.4 parts of isobutyltrimethoxysilne was dropwise added over 2 minutes under stirring at a number of revolutions of 2,000 rpm. Then, the resulting mixture was mixed and stirred for 3 minutes. Then, the mixture was dried at 120° C. for 1 hour. Then, the dried product was disintegrated and made to pass through a sieve of 100 μm in opening, and thus treated magnetic material 16 was obtained. The physical properties of the treated magnetic material 16 are shown in Table 1.

(Production of Treated Magnetic Materials 17 to 19)

Treated magnetic materials 17 to 19 were obtained in the same manner as in the production of the treated magnetic material 1 except that the magnetic iron oxide, the silane compound and the addition amount of the silane compound were altered as described in Table 1. The physical properties of the obtained treated magnetic materials 17 to 19 are shown in Table 1.

TABLE 1

| | Magnetic iron oxide No. | Content of silicon (% by mass)*1 | Content of alkali metals and alkali earth metals (% by mass)*2 | Surface-treating agent | Treating amount of surface treating agent (part by mass)*3 | Amount of adsorbed moisture (mg/m$^2$) |
|---|---|---|---|---|---|---|
| Treated magnetic material 1 | Magnetic iron oxide No. 1 | 0.10 | 0.0010 | Silane compound 1 | 3.3 | 0.20 |
| Treated magnetic material 2 | Magnetic iron oxide No. 3 | 0.05 | 0.0005 | Silane compound 1 | 4.0 | 0.21 |

TABLE 1-continued

| | Magnetic iron oxide No. | Content of silicon (% by mass)*1 | Content of alkali metals and alkali earth metals (% by mass)*2 | Surface-treating agent | Treating amount of surface treating agent (part by mass)*3 | Amount of adsorbed moisture ($mg/m^2$) |
|---|---|---|---|---|---|---|
| Treated magnetic material 3 | Magnetic iron oxide No. 4 | 0.50 | 0.0028 | Silane compound 2 | 3.5 | 0.18 |
| Treated magnetic material 4 | Magnetic iron oxide No. 4 | 0.50 | 0.0028 | Silane compound 3 | 3.5 | 0.23 |
| Treated magnetic material 5 | Magnetic iron oxide No. 4 | 0.50 | 0.0028 | Silane compound 4 | 3.5 | 0.24 |
| Treated magnetic material 6 | Magnetic iron oxide No. 6 | 0.50 | 0.0050 | Silane compound 4 | 3.5 | 0.24 |
| Treated magnetic material 7 | Magnetic iron oxide No. 7 | 0.50 | 0.0053 | Silane compound 4 | 3.5 | 0.25 |
| Treated magnetic material 8 | Magnetic iron oxide No. 8 | 0.50 | 0.0088 | Silane compound 4 | 3.5 | 0.25 |
| Treated magnetic material 9 | Magnetic iron oxide No. 7 | 0.50 | 0.0053 | Silane compound 4 | 2.5 | 0.27 |
| Treated magnetic material 10 | Magnetic iron oxide No. 7 | 0.50 | 0.0053 | Silane compound 4 | 2.8 | 0.28 |
| Treated magnetic material 11 | Magnetic iron oxide No. 7 | 0.50 | 0.0053 | Silane compound 5 | 3.5 | 0.27 |
| Treated magnetic material 12 | Magnetic iron oxide No. 7 | 0.50 | 0.0053 | Silane compound 6 | 3.5 | 0.30 |
| Treated magnetic material 13 | Magnetic iron oxide No. 7 | 0.50 | 0.0053 | Silane compound 7 | 3.5 | 0.30 |
| Treated magnetic material 14 | Magnetic iron oxide No. 8*4 | 0.50 | 0.0086 | Silane compound 4 | 3.5 | 0.30 |
| Treated magnetic material 15 | Magnetic iron oxide No. 1 | 0.10 | 0.0010 | Titanate compound | 3.5 | 0.46 |
| Treated magnetic material 16 | Magnetic iron oxide No. 1 | 0.10 | 0.0010 | Isobutyltrimethoxysilane | 4.0 | 0.42 |
| Treated magnetic material 17 | Magnetic iron oxide No. 4 | 0.50 | 0.0028 | Silane compound 4 | 2.2 | 0.33 |
| Treated magnetic material 18 | Magnetic iron oxide No. 2 | 0.03 | 0.0003 | Silane compound 3 | 4.0 | 0.29 |
| Treated magnetic material 19 | Magnetic iron oxide No. 5 | 0.55 | 0.0030 | Silane compound 3 | 3.5 | 0.27 |

*1The content of silicon represents the content proportion of silicon based on the magnetic iron oxide, at the time point where the dissolution proportion of the iron element reaches 5% by mass.
*2The content of the alkali metals and the alkali earth metals represents the total content proportion of the alkali metals and the alkali earth metals based on the magnetic iron oxide, at the time point where the dissolution proportion of the iron element reaches 5% by mass.
*3The treatment amount of the surface-treating agent represents the amount of the surface-treating agent exclusive of water from the aqueous solution.
*4Produced with the same composition as for the magnetic iron oxide 8, but without subjected to a drying step.

(Production of Toner 1)

In 720 parts of ion exchanged water, 450 parts of a 0.1 mol/L-$Na_3PO_4$ aqueous solution was placed and heated to 60° C., and then to the resulting solution, 67.7 parts of a 1.0 mol/L-$CaCl_2$ aqueous solution was added to yield a dispersion stabilizer-containing aqueous medium.

| | |
|---|---|
| Styrene | 78.0 parts |
| n-Butyl acrylate | 22.0 parts |
| Divinylbenzene | 0.6 part |
| Iron complex of monoazo dye (T-77, manufactured by Hodogaya Chemical Co., Ltd.) | 1.5 parts |
| Treated magnetic material 1 | 90.0 parts |
| Saturated polyester resin* | 7.0 parts |

(Saturated polyester resin*: obtained by the condensation reaction between an ethylene oxide adduct of bisphenol A and terephthalic acid; Mn=5,000, acid value=12 mg KOH/g, Tg=68° C.)

The above-described formulation was uniformly dispersed and mixed with an attritor (manufactured by Mitsui Miike Engineering Corp.) to yield a monomer composition. The monomer composition was warmed to 60° C., 12.0 parts of the Fischer-Tropsch wax was added to and mixed with the monomer composition, the wax was dissolved, and then 7.0 parts of dilauroyl peroxide as a polymerization initiator was dissolved in the mixture.

The monomer composition was placed in the aqueous medium, the resulting mixture was stirred for granulation at 60° C. in a $N_2$ atmosphere with a TK-type homomixer (manufactured by Tokushu Kika Kogyo Co., Ltd.) at 12,000 rpm for 10 minutes. Then, the mixture was allowed to react at 74° C. for 6 hours while the mixture was being stirred with a paddle stirring blade.

After the completion of the reaction, the resulting suspension liquid was cooled, then hydrochloric acid was added to the suspension liquid for cleaning, and then filtration and drying were performed to yield toner particles 1.

With a Henschel mixer (manufactured by Mitsui Miike Engineering Corp.), 100 parts of the toner particles 1 and 1.0 part of a hydrophobic silica fine powder having a number average primary particle size of 12 nm were mixed together to yield toner 1 having a weight average particle size (D4) of 6.5 μm.

(Production of Toners 2 to 14 and 16 to 21)

Toners 2 to 14 and 16 to 21 were each obtained in the same manner as in the production of the toner 1 except that the treated magnetic material 1 used in the preparation of the toner 1 was altered as shown in Table 2. The magnetic material used for each of the toners and the weight average particle size (D4) of each of the toners are shown in Table 2.

(Production of Toner 15)

Styrene/n-butyl acrylate copolymer (mass ratio: 78/22)

| | |
|---|---|
| Styrene/n-butyl acrylate copolymer (mass ratio: 78/22) | 100.0 parts |
| Treated magnetic material 13 | 90.0 parts |
| Fischer-Tropsch wax | 12.0 parts |
| Iron complex of monoazo dye (T-77, manufactured by Hodogaya Chemical Co., Ltd.) | 1.5 parts |
| Saturated polyester resin used in the preparation of toner 1 | 7.0 parts |

The above listed materials were mixed together with a blender, the resulting mixture was melt-kneaded with a double screw extruder heated at 130° C., the cooled kneaded mixture was coarse-crushed with a hammer mill, the coarse-crushed mixture was fine-pulverized with a jet mill, and then the fine-pulverized product was pneumatically classified to yield toner particles 2. With a Henschel mixer (manufactured by Mitsui Miike Engineering Corp.), 100 parts of the toner particles 2 and 1.0 part of a hydrophobic silica fine powder having a number average primary particle size of 12 nm were mixed together to yield toner 15 having a weight average particle size (D4) of 6.6 μm.

TABLE 2

| | Magnetic material | Weight average particle size (D4) |
|---|---|---|
| Toner 1 | Treated magnetic material 1 | 6.5 μm |
| Toner 2 | Treated magnetic material 2 | 6.6 μm |
| Toner 3 | Treated magnetic material 3 | 6.4 μm |
| Toner 4 | Treated magnetic material 4 | 6.7 μm |
| Toner 5 | Treated magnetic material 5 | 6.6 μm |
| Toner 6 | Treated magnetic material 6 | 6.5 μm |
| Toner 7 | Treated magnetic material 7 | 6.8 μm |
| Toner 8 | Treated magnetic material 8 | 6.3 μm |
| Toner 9 | Treated magnetic material 9 | 6.4 μm |
| Toner 10 | Treated magnetic material 10 | 6.6 μm |
| Toner 11 | Treated magnetic material 11 | 6.3 μm |
| Toner 12 | Treated magnetic material 12 | 6.8 μm |
| Toner 13 | Treated magnetic material 13 | 6.5 μm |
| Toner 14 | Treated magnetic material 14 | 6.2 μm |
| Toner 15 | Treated magnetic material 14 | 6.6 μm |
| Toner 16 | Magnetic iron oxide No. 1 | 6.7 μm |
| Toner 17 | Treated magnetic material 15 | 6.6 μm |
| Toner 18 | Treated magnetic material 16 | 6.2 μm |
| Toner 19 | Treated magnetic material 17 | 6.4 μm |
| Toner 20 | Treated magnetic material 18 | 6.3 μm |
| Toner 21 | Treated magnetic material 19 | 6.6 μm |

Example 1

Image Forming Apparatus

As an image forming apparatus, LBP3100 (manufactured by Canon) was used. The toner 1 was used, and transverse lines were printed with a coverage rate of 2% on 3,000 sheets in a one-sheet intermittent mode both in an environment of normal temperature and normal humidity (23° C./60% RH) and in an environment of high temperature and high humidity (32.5° C./80% RH). Then, in each environment, the printing system was allowed to stand for 7 days, and then again printing was performed, and the image density, fog and ghost after being allowed to stand were evaluated.

Consequently, both before and after the running test, images high in the density and free from the fog and ghost in the non-image area can be obtained. Even after the printing system was allowed to stand for 7 days, a satisfactory image with no decrease in the image density and free from the ghost was obtained. The evaluation results in an environment of normal temperature and normal humidity are shown in Table 3, and the evaluation results in an environment of high temperature and high humidity are shown in Table 4.

The evaluation methods for the individual evaluations and the evaluation standards thereof are described below.

[Image Density]

The image density was determined as follows. A solid image area was formed and the density of the solid image was measured with the MacBeth Reflectodensitometer (manufactured by MacBeth Co., Ltd.).

[Fog]

A white image was output to a sheet of transfer paper, and the reflectance of the white image was measured with the REFLECTMETER MODEL TC-6DS manufactured by Tokyo Denshoku Co., Ltd. The reflectance of the transfer paper (standard paper) before the formation of the white image was also measured in the same manner. At that time, a green filter was used. The fog was calculated from the reflectance values obtained before and after the output of the white image by using the following Formula.

$$\text{Fog (reflectance)(\%)} = \text{reflectance(\%) of standard paper} - \text{reflectance(\%) of white image sample}$$

The evaluation standards of fog are as follows.

A: Extremely satisfactory (less than 1.5%)

B: Satisfactory (1.5% or more and less than 2.5%)

C: Average (2.5% or more and less than 4.0%)

D: Poor (4% or more)

[Ghost]

Two or more 10 mm×10 mm solid images were formed on the first half of the sheets of transfer paper and a two dots-three space half-tone images were formed on the second half of the sheets of transfer paper. The extent to which the traces of the solid images appear on the half-tone images is graded through visual inspection.

A: Extremely satisfactory (no ghost occurs)

B: Satisfactory

C: Ghost is found without any practical problem.

D: Ghost remarkably occurs.

Examples 2 to 15 and Comparative Examples 1 to 6

The image print-out test was performed in the same manner as in Example 1 except that the toners 2 to 21 were used.

The evaluation results in an environment of normal temperature and normal humidity are shown in Table 3, and the evaluation results in an environment of high temperature and high humidity are shown in Table 4.

TABLE 3

| | | Environment of normal temperature and normal humidity | | | | | | | | |
|---|---|---|---|---|---|---|---|---|---|---|
| | | Initial stage | | | After 3,000-sheet printing | | | After 7-day standing subsequent to 3,000-sheet image print-out | | |
| | Toner | Image density | Fog | Ghost | Image density | Fog | Ghost | Image density | Fog | Ghost |
| Example 1 | Toner 1 | 1.53 | A (0.3%) | A | 1.52 | A (0.4%) | A | 1.50 | A (0.5%) | A |
| Example 2 | Toner 2 | 1.54 | A (0.3%) | A | 1.52 | A (0.4%) | A | 1.51 | A (0.5%) | A |
| Example 3 | Toner 3 | 1.53 | A (0.3%) | A | 1.51 | A (0.5%) | A | 1.50 | A (0.5%) | A |
| Example 4 | Toner 4 | 1.47 | A (0.6%) | A | 1.45 | A (0.8%) | B | 1.43 | A (1.0%) | B |
| Example 5 | Toner 5 | 1.44 | A (1.2%) | B | 1.42 | A (1.4%) | B | 1.40 | B (1.6%) | B |
| Example 6 | Toner 6 | 1.43 | A (1.2%) | B | 1.41 | A (1.4%) | B | 1.40 | B (1.6%) | B |
| Example 7 | Toner 7 | 1.43 | A (1.4%) | B | 1.40 | B (1.9%) | B | 1.38 | B (2.1%) | B |
| Example 8 | Toner 8 | 1.41 | A (1.4%) | B | 1.39 | B (1.9%) | B | 1.38 | B (2.1%) | B |
| Example 9 | Toner 9 | 1.41 | B (1.9%) | B | 1.38 | B (2.1%) | B | 1.36 | B (2.3%) | B |
| Example 10 | Toner 10 | 1.40 | B (1.9%) | B | 1.37 | B (2.1%) | B | 1.35 | B (2.3%) | B |
| Example 11 | Toner 11 | 1.42 | B (1.9%) | B | 1.37 | B (2.1%) | B | 1.35 | B (2.3%) | B |
| Example 12 | Toner 12 | 1.41 | B (2.1%) | B | 1.37 | B (2.3%) | B | 1.33 | B (2.4%) | B |
| Example 13 | Toner 13 | 1.41 | B (2.1%) | B | 1.36 | B (2.3%) | B | 1.33 | B (2.4%) | B |
| Example 14 | Toner 14 | 1.40 | B (2.2%) | B | 1.36 | B (2.3%) | B | 1.34 | B (2.4%) | C |
| Example 15 | Toner 15 | 1.36 | B (2.3%) | B | 1.34 | B (2.4%) | B | 1.32 | B (2.7%) | C |
| Comparative Example 1 | Toner 16 | 1.24 | D (4.5%) | C | 1.19 | D (4.7%) | C | 1.16 | D (4.9%) | C |
| Comparative Example 2 | Toner 17 | 1.28 | C (3.6%) | B | 1.25 | C (3.8%) | C | 1.23 | C (3.9%) | C |
| Comparative Example 3 | Toner 18 | 1.38 | B (2.3%) | B | 1.35 | B (2.4%) | B | 1.33 | B (2.4%) | C |
| Comparative Example 4 | Toner 19 | 1.40 | A (1.4%) | B | 1.37 | B (1.9%) | B | 1.35 | B (2.1%) | C |
| Comparative Example 5 | Toner 20 | 1.43 | A (1.4%) | A | 1.40 | B (2.0%) | B | 1.38 | B (23%) | C |
| Comparative Example 6 | Toner 21 | 1.42 | A (1.3%) | B | 1.40 | B (2.1%) | B | 1.37 | B (2.4%) | C |

TABLE 4

| | | Environment of high temperature and high humidity | | | | | | | | |
|---|---|---|---|---|---|---|---|---|---|---|
| | | Initial stage | | | After 3,000-sheet printing | | | After 7-day standing subsequent to 3,000-sheet image print-out | | |
| | Toner | Image density | Fog | Ghost | Image density | Fog | Ghost | Image density | Fog | Ghost |
| Example 1 | Toner 1 | 1.51 | A (0.2%) | A | 1.49 | A (0.3%) | A | 1.47 | A (0.3%) | A |
| Example 2 | Toner 2 | 1.51 | A (0.2%) | A | 1.48 | A (0.3%) | A | 1.46 | A (0.3%) | A |
| Example 3 | Toner 3 | 1.52 | A (0.2%) | A | 1.49 | A (0.3%) | A | 1.46 | A (0.3%) | A |
| Example 4 | Toner 4 | 1.48 | A (0.4%) | A | 1.46 | A (0.7%) | A | 1.41 | A (0.9%) | B |
| Example 5 | Toner 5 | 1.43 | A (1.1%) | B | 1.39 | B (1.5%) | B | 1.35 | B (1.5%) | B |
| Example 6 | Toner 6 | 1.42 | A (1.1%) | B | 1.38 | B (1.5%) | B | 1.35 | B (1.6%) | B |
| Example 7 | Toner 7 | 1.40 | B (1.6%) | B | 1.36 | B (1.9%) | B | 1.33 | B (2.0%) | B |

TABLE 4-continued

| | | Environment of high temperature and high humidity | | | | | | | | |
|---|---|---|---|---|---|---|---|---|---|---|
| | | Initial stage | | | After 3,000-sheet printing | | | After 7-day standing subsequent to 3,000-sheet image print-out | | |
| | Toner | Image density | Fog | Ghost | Image density | Fog | Ghost | Image density | Fog | Ghost |
| Example 8 | Toner 8 | 1.39 | B (1.6%) | B | 1.36 | B (1.9%) | B | 1.33 | B (2.0%) | B |
| Example 9 | Toner 9 | 1.38 | B (1.8%) | B | 1.35 | B (2.1%) | B | 1.32 | B (2.2%) | C |
| Example 10 | Toner 10 | 1.39 | B (1.8%) | B | 1.36 | B (2.1%) | B | 1.32 | B (2.2%) | C |
| Example 11 | Toner 11 | 1.39 | B (1.8%) | B | 1.35 | B (2.1%) | B | 1.32 | B (2.2%) | C |
| Example 12 | Toner 12 | 1.38 | B (2.0%) | B | 1.34 | B (2.3%) | C | 1.32 | B (2.4%) | C |
| Example 13 | Toner 13 | 1.38 | B (2.1%) | B | 1.34 | B (2.3%) | C | 1.32 | B (2.4%) | C |
| Example 14 | Toner 14 | 1.37 | B (2.2%) | B | 1.34 | B (2.4%) | C | 1.30 | C (2.6%) | C |
| Example 15 | Toner 15 | 1.31 | B (2.2%) | C | 1.30 | B (2.4%) | C | 1.27 | C (2.7%) | C |
| Comparative Example 1 | Toner 16 | 1.18 | D (4.1%) | C | 1.09 | D (4.3%) | D | 0.82 | D (4.4%) | C |
| Comparative Example 2 | Toner 17 | 1.23 | C (3.4%) | C | 1.16 | C (3.6%) | C | 0.98 | C (3.8%) | D |
| Comparative Example 3 | Toner 18 | 1.34 | B (2.2%) | B | 1.30 | B (2.4%) | C | 1.18 | B (2.4%) | D |
| Comparative Example 4 | Toner 19 | 1.35 | B (2.1%) | B | 1.32 | B (2.4%) | C | 1.19 | B (2.4%) | D |
| Comparative Example 5 | Toner 20 | 1.38 | A (1.3%) | B | 1.33 | B (1.8%) | C | 1.21 | C (2.6%) | D |
| Comparative Example 6 | Toner 21 | 1.37 | A (1.2%) | B | 1.34 | B (1.7%) | B | 1.22 | B (2.3%) | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-123674, filed May 31, 2010, which is hereby incorporated by reference herein in its entirety.

What is claimed is:

1. A magnetic toner comprising magnetic toner particles, each of the toner particles containing a binder resin and a magnetic material, and an inorganic fine powder, wherein:

(1) the magnetic material is prepared by treating magnetic iron oxide on the surface with a silane compound;

(2) when the magnetic iron oxide is dispersed in an aqueous solution of hydrochloric acid and dissolved until the dissolution proportion of the iron element reaches 5% by mass based on the total amount of the iron element contained in the magnetic iron oxide, the amount of silicon eluted by that point of time is 0.05% by mass or more and 0.50% by mass or less based on the magnetic iron oxide; and (3) the magnetic material has a moisture adsorption amount per unit area of 0.30 $mg/m^2$ or less.

2. The magnetic toner according to claim 1, wherein the magnetic material is prepared by treating, in a gas phase, the magnetic iron oxide on the surface with a silane compound.

3. The magnetic toner according to claim 1, wherein when the magnetic iron oxide is dispersed in an aqueous solution of hydrochloric acid and dissolved until the dissolution proportion of the iron element reaches 5% by mass based on the total amount of the iron element contained in the magnetic iron oxide, the total amount of the alkali metals and the alkali earth metals eluted by that point of time is 0.0050% by mass or less based on the magnetic iron oxide.

4. The magnetic toner according to claim 1, wherein the silane compound is a compound prepared by applying a hydrolysis treatment to an alkoxysilane and has a hydrolysis rate of 50% or more.

* * * * *